US006875036B1

(12) United States Patent
Kan et al.

(10) Patent No.: US 6,875,036 B1
(45) Date of Patent: Apr. 5, 2005

(54) MULTI-PURPOSE PLUG-IN LAMP SOCKET

(75) Inventors: Kenneth M. Kan, Trumbull, CT (US); Jeremy S. Brotchner, Forest Hills, NY (US); Christopher S. Fone, Florida, NY (US)

(73) Assignee: Lighting Services Inc., Stony Point, NY (US)

( * ) Notice: Subject to any disclaimer, the term of this patent is extended or adjusted under 35 U.S.C. 154(b) by 21 days.

(21) Appl. No.: 10/628,279

(22) Filed: Jul. 28, 2003

(51) Int. Cl.[7] ..... H01R 27/00
(52) U.S. Cl. ..... 439/220; 439/856
(58) Field of Search ..... 439/218, 217, 439/220, 856, 619, 699.2, 564, 573, 830; 362/226

(56) References Cited

U.S. PATENT DOCUMENTS

| | | | | |
|---|---|---|---|---|
| 746,483 | A * | 12/1903 | Fielding | 439/573 |
| 1,260,085 | A | 3/1918 | Snyder | |
| 2,297,374 | A | 9/1942 | Tingle | |
| 2,912,665 | A | 11/1959 | Irwin | |
| 2,920,301 | A | 1/1960 | Kawate | |
| 2,976,511 | A | 3/1961 | Lipsitz | |
| 3,069,377 | A | 12/1962 | Matsui | |
| 3,192,498 | A * | 6/1965 | Ruehlemann | 439/223 |
| 3,245,025 | A | 4/1966 | Goddard et al. | |
| 3,259,868 | A | 7/1966 | Irwin | |
| 3,609,333 | A | 9/1971 | Iwaki | |
| 5,013,961 | A | 5/1991 | Reedy | |
| 5,203,626 | A | 4/1993 | Clement | |
| 6,315,611 | B1 * | 11/2001 | Sawada et al. | 439/619 |

* cited by examiner

*Primary Examiner*—Tho D. Ta
*Assistant Examiner*—Felix O. Figueroa
(74) *Attorney, Agent, or Firm*—Schweitzer Cornman Gross & Bondell LLP

(57) ABSTRACT

A multi-purpose plug-in lamp socket for selectively mounting and electrically connecting lamps of different types, such as PAR36 and AR111 lamps. These lamps, which are extensively used in low voltage commercial and theatrical lighting, are similar in size but have entirely different configurations of contact elements. Typically, they are mounted by seating peripheral flanges of the lamps and separately electrically connecting the contact elements using slide-on contacts and/or spade lugs or the like secured by screws. The disclosure relates to a simple, unitary lamp socket which accommodates plug-in reception and removal of either of the above mentioned styles of lamp, simultaneously mounting and electrically connecting the lamps for use. Strip-like contact elements, mounted at the back of the lamp bodies, are gripped by contact clips mounted in a socket body. The clips are formed with upper and lower pairs of protuberant retention elements which engage and position the contact strips such that, upon insertion of either type of lamp, the lamp is simultaneously physically held in position and electrically connected, notwithstanding major differences in the contact configuration of the different lamps.

11 Claims, 4 Drawing Sheets

MULTI-PURPOSE PLUG-IN LAMP SOCKET

BACKGROUND OF INVENTION

Commercial and theatrical lighting systems, for example, make extensive use special lamps, such as lamps known commercially as PAR36 and AR111. These are lamps made to different specifications, designed to be used interchangeably in low voltage spotlights, for example, used in track lighting, specialized theatrical and commercial lighting and the like. These standardized lamp types are provided at the back of their respective lamp bodies with specially configured, strip-like contact elements, by means of which the lamps are connected to a suitable power source.

It is desirable to design and construct spotlight housings to accommodate different types of lamps, such as the PAR36 and AR111, in the interest of user convenience and manufacturing economies. Additionally, a user of the spotlight units may choose to change the type of lamp mounted therein from time to time, in order to achieve different lighting effects available from the different lamps.

Because of a fundamentally different physical character of the contact structure at the back of the PAR36 and AR111 lamps, for example, it has been common practice to design spotlight units utilizing such lamps to provide for mounting the lamps by physically engaging their outer peripheries. In this respect, the lamps are of similar diameters and are provided with similar external flange configurations, enabling seating of the flanges of different lamps in the same spotlight fixture. Electrical connections to the lamps are in such cases made by attaching individual wires to the individual contacts of the lamps. The contact structures of the lamps accordingly typically are provided with contact screws for the attachment of spade lugs, for example, or tabs for receiving quick disconnect terminals, for example. In these cases, installation or changing of a lamp requires initial connection of wires to the contact elements, followed by positioning of the lamp within an annular seating recess. In all cases, this is a two-handed operation, typically performed by a workman standing on a ladder and requiring considerable care and expenditure of time.

While plug-in installation of lamps of the type referred to above is feasible, and sometimes practiced, it presents a considerable disadvantage in that, because of the highly disparate nature of the contact structure of the lamps, plug-in sockets have been required to be dedicated to a particular style of lamp, resulting in manufacturing inefficiencies and limitations on the user's ability to change lighting characteristics.

SUMMARY OF INVENTION

The present invention is directed to a uniquely novel and advantageous form of multi-purpose plug-in lamp socket which is capable of alternatively receiving lamps with significantly different contact structures, such as in particular in the PAR36 and AR111 styles of low voltage lamps. The multi-purpose socket of the invention is adapted for straight plug-in reception of either PAR36 or AR111 lamps in a manner that simultaneously completes the necessary electrical contact with the lamps and securely mounts and positions the lamp. Among other things, in a given spotlight unit, lamps can be replaced and/or interchanged as a one-handed operation, by simply extracting an existing lamp and replacing it with a new one with a plug-in action.

The contact structure for an AR111 lamp consists of a pair of contact elements of strip-like conductive material having an inverted L-shaped configuration, with generally horizontally extending first portions and generally vertically downwardly extending second portions. These contact elements are rigidly mounted on an insulator block of generally rectangular configuration. With the PAR36 lamp, on the other hand, the contact elements, likewise of strip-like material, comprise generally horizontal portions joined by upwardly angled portions which in turn are joined by generally vertically upwardly extending portions. These are rigidly joined to the lamp body by generally cylindrical mounting elements extending from the back of the lamp body and engaging the horizontal portions of the contact strips.

In a preferred embodiment of the invention, the new lamp socket comprises a socket body, formed of a suitable relatively rigid, non-conducting material. Spaced apart contact clips are mounted in the socket body, with connections to an electrical power source leading therefrom. The contact clips are formed of a suitably resilient, conductive material, preferably of a generally U-shaped configuration, suitable for plug-in reception of the relatively flat, strip-like contact elements of PAR36, AR111 or similar lamps. In accordance with an aspect of the invention, contact clips are provided with closely spaced pairs of protuberant retention elements, preferably in the form of small circular dimples, positioned and arranged to engage portions of the contact elements to simultaneously engage and retentively position the contact elements of the lamps.

Significantly, the associated pairs of dimples, forming the protuberant retention elements, are so located as to effectively engage both the L-shaped contact elements of the AR111 lamp, and the somewhat reversely configured contact elements of the PAR36 lamp, in either case allowing the lamps to be inserted into the socket with a straight plug-in motion. An upper set of dimples serves to provide a tactile, snap-in effect, so that the installer can easily feel when the lamp is properly seated in the socket. The lower set of dimples, positioned slightly below the upper set, resists further plug-in motion, and results in the contact elements being resiliently captured between the pairs of dimples. Thus, upon a simple plug-in motion the desired electrical contact is established with the lamp, positioned within its fixture in the desired manner.

Preferably the socket body is comprised of a pair of identical half parts which, when secured together, automatically capture the contact clips, such that assembly of the device is efficient and economical.

For a more complete understanding of the above and other features and advantages of the invention, reference should be made to the following detailed description of a preferred embodiment, and to the accompanying drawings.

DESCRIPTION OF A PREFERRED EMBODIMENT

Figure 1:
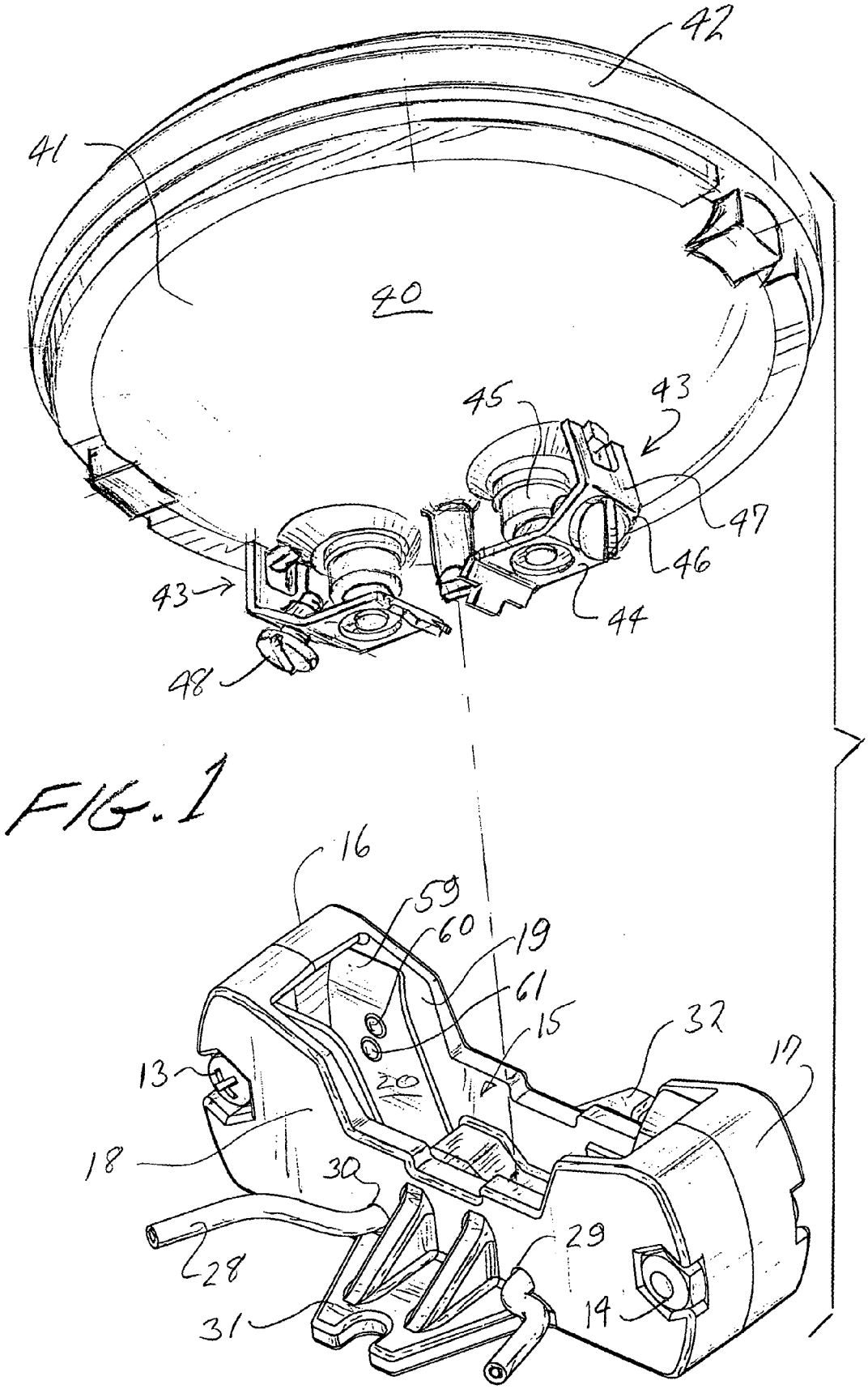
FIG. 1 is an exploded perspective view of a lamp socket according to the invention arranged to receive a lamp of PAR36 type configuration.

Referring now to the drawings, a lamp socket 10 according to the invention comprises a socket body formed of a pair of identical body parts 11, 12 preferably injection molded of a suitable plastic material. In a typical application, the socket may be exposed to significant heat, and a heat-resistant, structural plastic material, such as glass-reinforced polyphthalamide (PPA) resin is particularly suitable. Desirably, the socket body parts 11, 12 are identically configured and are arranged to be secured in facing pairs by means of bolts 13 and nuts 14 installed at each end of the socket body. When the body parts are assembled and secured, they form an upwardly opening cavity 15 closed by opposed end walls 16, 17 and spaced apart side walls 18, 19.

Contact clips 20 are arranged to be positioned within the cavity 15 of the socket body, as reflected in FIG. 1. The contact clips are formed of a suitably springy, conductive material, for example beryllium copper of around 0.032 inch thickness, preferably nickel plated. Each contact clip is formed in a generally U-shaped configuration defined by spaced apart contact side walls 21, 22 and connecting bottom walls 23. Portions 24, 25 of the bottom wall project a short distance beyond the end edges of the side walls 20, 21. These projecting end portions are arranged to be received in confining cavities 26, 27 in the respective socket body parts 11, 12 such that, when the contact clips are installed between the socket body parts 11, 12, and the latter are secured together by the bolts 13, the contact clips are locked in place by their projecting bottom portions 24, 25.

Figure 2:
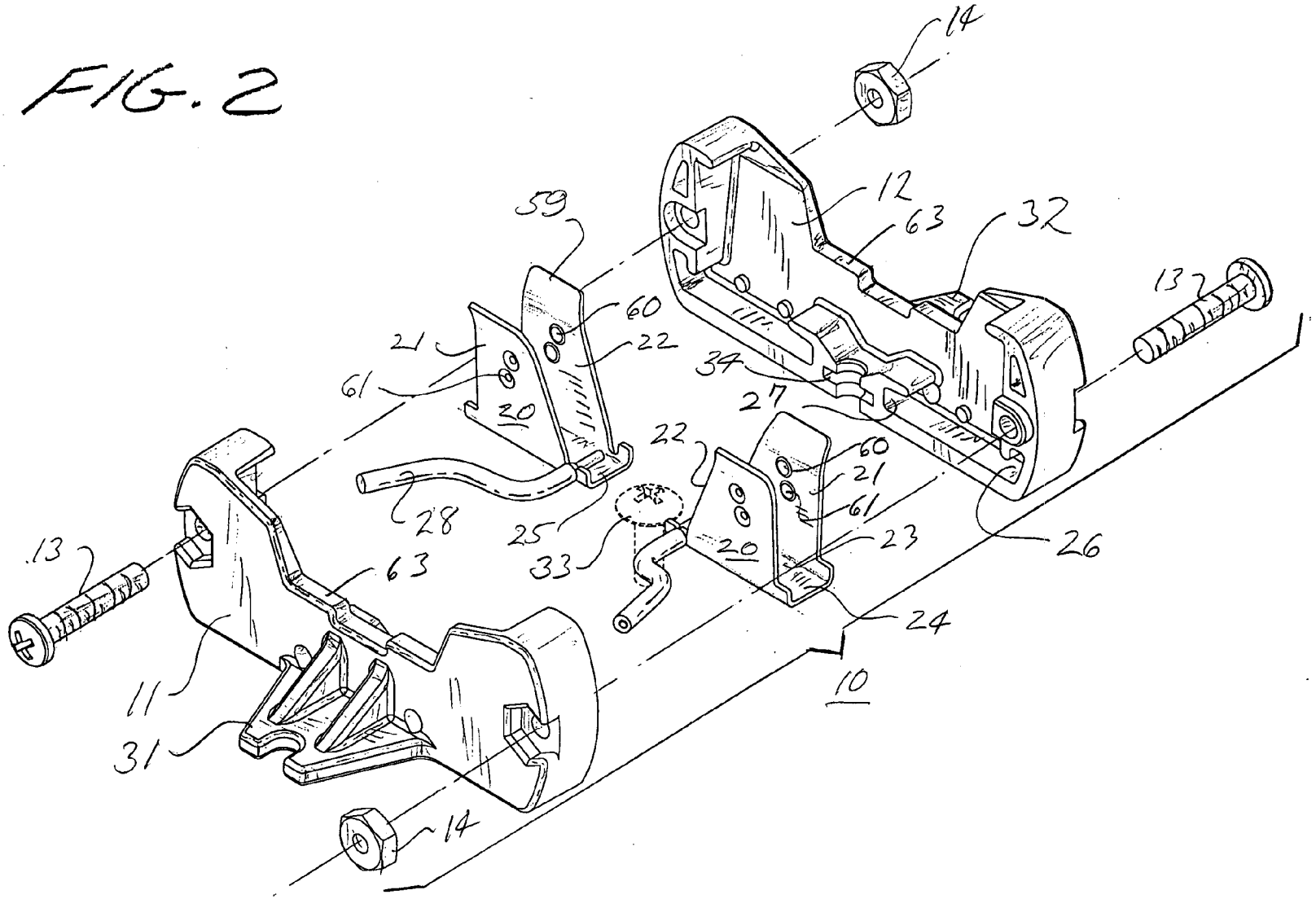
FIG. 2 is an exploded view of the lamp socket itself, illustrating its various component parts.

As illustrated in FIG. 2, the projecting bottom portions 25 at the inner ends of the contact clips are notched to receive exposed ends of wires 28, which are suitably secured to the contact clips, as by soldering, welding or mechanical means. When the clips are installed in the body parts 11, 12, the wires are led through openings 29, 30 in the side wall 19 (see FIG. 1) for connection to the light fixture or other unit in which the socket is eventually installed.

If the socket is to be mounted in fixed relation, it can be secured by means of mounting flanges 31, 32, extending laterally from bottom portions of the socket body parts 11, 12. Where rotational adjustment of the socket body is to be accommodated, a flat headed screw 33 (FIG. 2) can be installed in a cavity 34 in the bottom of the socket body, with the screw extending downward for engagement with the lighting fixture (not shown). This arrangement allows rotational adjustment of the socket body about a central vertical axis as appropriate, which may be desired in connection with lamps having oriented output beams.

Figure 4:
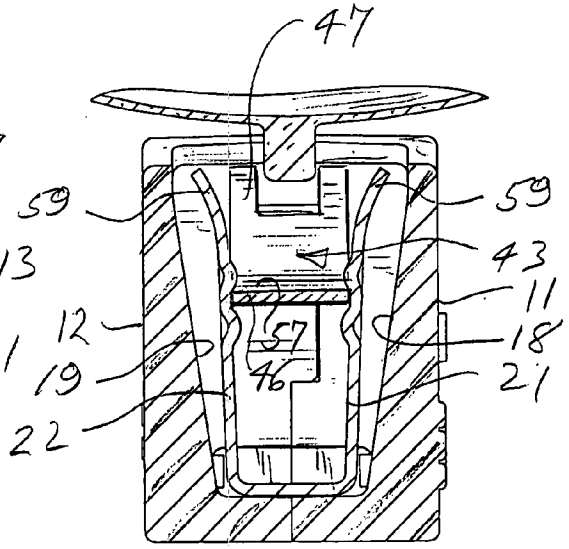
FIG. 4 is a fragmentary cross sectional view as taken generally on line 4—4 of FIG. 3.
Figure 3:
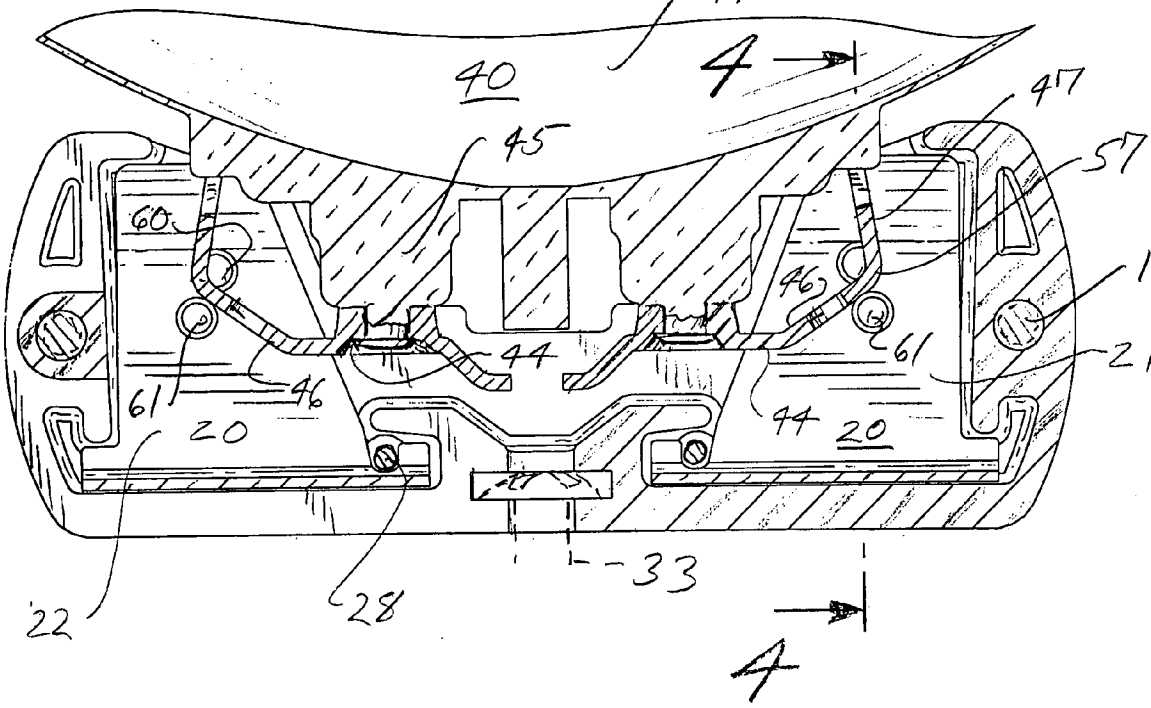
FIG. 3 is a fragmentary longitudinal cross sectional view of the lamp socket, illustrating a PAR36 type lamp mounted therein.

FIGS. 1, 3 and 4 illustrate features of a PAR36 style of lamp, which is widely used in commercial and theatrical lighting. The lamp 40 comprises a reflecting body 41 typically provided with a surrounding flange 42 which is commonly employed for mounting the lamp in a lighting fixture. At the back portion of the reflecting body there are contact elements 43, which are formed of flat, strip-like conductive material. In the PAR36 style of lamp, the contact elements 43 comprise flat, generally horizontal first portions 44 by which the contact elements are physically mounted and electrically connected to insulated posts 45. The contact elements 43 include generally flat, planar second portions 46 which extend outward and upward from outer edges of the first planar portions 44. Generally flat, planar third portions 47 extend generally vertically upward from outer edges of the second portions 46, as indicated in FIGS. 1 and 3. The contact elements 43 are formed of a stiff material of approximately ⅜ inch in width. Typically, contact screws 48 are provided on the upwardly angled second portions 46 of the contact elements (to accommodate attachment of connecting wires in more conventional installations).

Figures 5, 6:
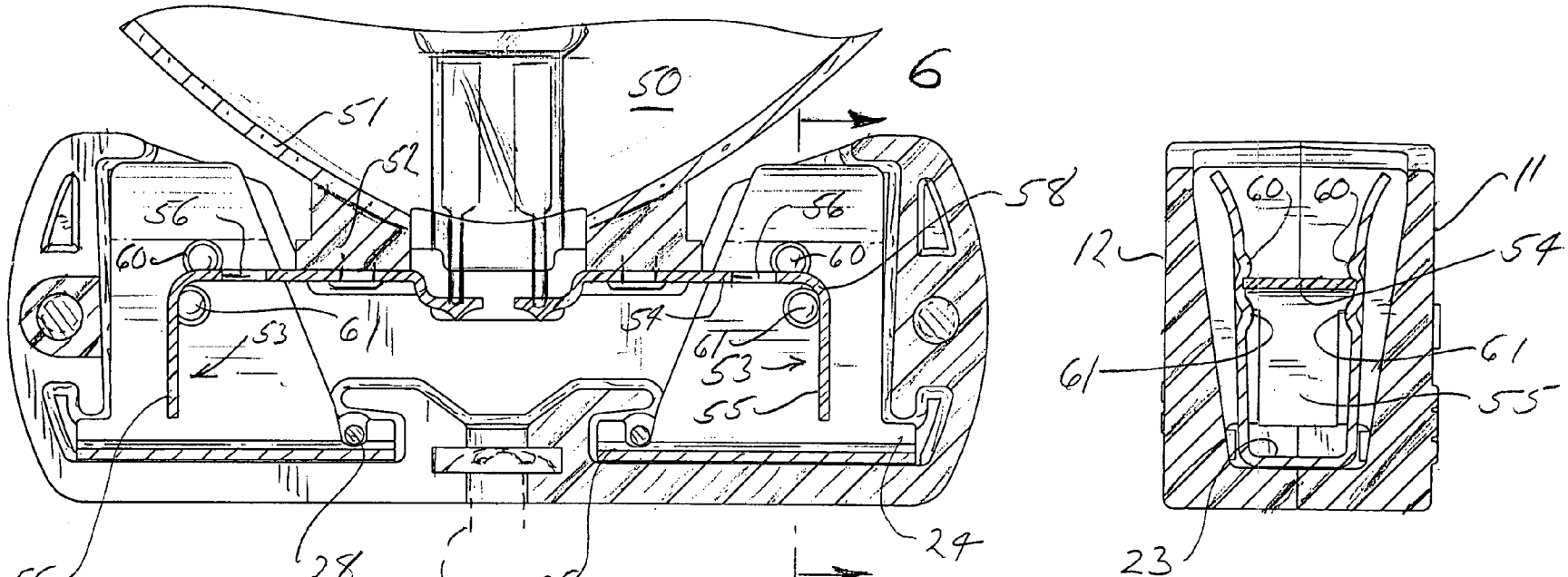
FIG. 5 is a fragmentary longitudinal cross sectional view, similar to FIG. 3, illustrating the lamp socket with an AR111 style lamp mounted therein.
FIG. 6 is a cross sectional view as taken generally on line 6—6 of FIG. 5.

FIG. 5 illustrates an AR111 style lamp 50. The AR111 lamp includes a reflecting body 51 having a generally rectangular insulating body 52 at its base. The insulating body 52 mounts contact elements 53 of strip-like material of a width similar to that of elements 43 of the PAR36 lamps (approximately ⅜"). The contact elements 53 have a generally inverted L-shaped configuration comprised of generally flat, horizontal, planar first portions 54 and generally flat, vertically downwardly extending planar second portions 55. Typically, the contact elements 53 are provided with screws (not shown to facilitate illustration of the invention) received in threaded openings 56 and providing a means for attachment of wires. The downwardly extending portions 55 also typically accommodate the reception of quick-connect contact lugs. The screws and the tabs are conventionally provided for instances in which the lamp is separately mounted (typically by a peripheral flange), with the electrical contact being established by a separate operation.

It will be noted in comparing the contact configuration of the PAR36 style lamp, in FIG. 3 to the AR111 style lamp in FIG. 5 that the contact strips are bent upwardly in one case (PAR36) and downwardly in the other (AR111). In the PAR36 configuration (FIG. 3) the juncture between the generally flat planar second and third portions 46, 47 forms an upwardly facing inside corner 57, whereas the juncture of the planar portions 54, 55 of the AR111 contact strips form a downwardly facing inside corner 58.

Pursuant to the invention, the contact clips 20 of the lamp socket are formed with specially positioned protuberant retention elements 60, 61, preferably in the form of dimples which project inwardly of the side walls of the clips. As is evident in FIGS. 3 and 5, the dimples 60 are spaced above and are offset laterally inward from the dimples 61. This arrangement takes into account the dimensional differences between the overall width of the contact elements 43 of the PAR36 lamp and the contact elements 53 of the AR111 lamp, the latter of which are somewhat wider (as viewed in FIGS. 3 and 5). The positioning of the lower dimples 61 is such as to cause them to lie just inside of the vertically downwardly extending portions 55 of the AR111 contact elements, when the latter are inserted into the contact clips 20 of the socket. Likewise, the slightly inwardly offset positions of the upper dimples 60 are such as to position them just on the insides of the upwardly extending portions 47 of the contact elements 43 of the PAR36 lamp. The vertical spacing between the sets of dimples 60, 61 is such as to closely accommodate the horizontal contact portions 56, in the case of the AR111 lamp, and the upwardly angled contact portions 46, in the case of the PAR36 lamp.

Either of the described lamps can be installed in the socket of the invention by an inward plug-in installation of the contact portions of the lamp into the socket. Upper portions 59 of the contact clips advantageously are flared outwardly to facilitate initial entry of the contact elements.

As the contact elements 43 of a PAR36 lamp are pressed inwardly into the contact clips, the side walls 21, 22 are displaced outwardly, providing limited resistance until the upper dimples 60 are encountered by the upwardly angled contact portions 46, requiring the side walls 21, 22 of the contact clips to be displaced outward. The plug-in motion will encounter substantial additional resistance as the dimples 60 are encountered, and that resistance will be correspondingly relieved as the side edges of the contact elements pass over the tops of the dimples, providing a tactile feel to the installer that the lamp has reached a properly installed position.

When the PAR36 lamp is properly installed, lower surfaces of the upwardly angled contact portions of the PAR36 lamp will be engaged and supported by the lower dimples 61 such that the lamp is mechanically held in position by the "capture" of the contact portions 46 between the respective protuberant dimples 60, 61. Additionally, the upper dimples 60 are received closely in the inside corners 57, providing lateral as well as vertical positioning of the lamp. Side edges of the upwardly extending contact portions 47 are engaged by opposite side walls 21, 22 of the contact clips to provide lateral stability to the lamp. Thus, as will be readily apparent, all that is required to physically mount and electrically connect the lamp 40 of FIG. 3 is the inward plug-in motion to achieve the snap-in engagement of the contact portions 46 with the respective pairs of dimples 60, 61. There is a definite tactile snap-in feel involved in this plug-in action that can be easily detected by the installer, such that installation is very quick and efficient.

In the case of the AR111 style of lamp, shown in FIG. 5, the installation procedure is essentially the same as described with respect to the PAR36 style. The contact elements 53 are inserted into the contact clips 20 of the socket, with the vertically extending contact portions 55 being guided along outside portions of the lower dimples 61 until the installer feels the tactile, snap-in action of the horizontal contact portions 54 passing over the upper dimples 60. Once installed in the manner shown in FIG. 5, the contact elements 53 are confined laterally and vertically by the pairs of dimples 60, 61, and the lamp is stabilized by confinement of the downwardly extending contact portions 55 between opposite side walls of the contact clips. As shown in FIG. 5, the lower dimples 61 are closely received in the inside corners 58 formed by the L-shaped contacts.

As indicated in FIG. 5, the AR111 style lamp mounts an insulating base 52. Typically, this is a member of generally rectangular configuration, the width of which, transversely of the orientation of the contact elements 53, is wider than the spacing of the side walls 18, 19 of the socket body. Accordingly, the central sidewall portions are recessed at 63 to accommodate the presence of the insulator block.

To advantage, the inward projection of the lower dimples 61 is slightly greater than the inward projection of the upper dimples 60. In a particularly preferred embodiment of the invention, for example, the lower dimples may have an inward projection of approximately 0.025 inch, whereas the upper dimples may have an inward projection of around 0.017 inch (referenced in both cases to the principal inside surfaces of the contact clip side walls 21, 22). The differential projection of the respective dimples 60, 61 is advantageous from the standpoint of accommodating relatively easier movement of the lamp contact elements past the upper dimples, during installation and removal of the lamps, while providing significant resistance to passage of the contact elements beyond the lower dimples, such that the lamp becomes firmly seated after the contact elements pass over the upper dimples 60.

The dimples 60, 61 advantageously may have an outside diameter of around ⅛th inch, and are of rounded contour, at least in the case of the upper dimples 60, so as to accommodate an easy plug-in insertion of the lamp, and its subsequent removal in the same manner. A preferred vertical separation of the respective upper and lower dimples is approximately 0.145 inch, center to center, and the upper dimples advantageously are offset approximately 0.039 inch (center-to-center) to the inside of the lower dimples 61. This unique geometry enables the lamp socket of the invention to physically and electrically accommodate the rather significantly disparate contact and base structure of the PAR36 and AR111 style lamps.

With the lamp socket of the invention, the tasks of installing, removing, and/or exchanging lamps of the type described, in commercial and theatrical lighting systems, is greatly simplified and expedited (as well as made safer) by enabling these operations to be accomplished by a workman using only one hand on the lamp. More conventional installations, by contrast, require the lamp to be connected electrically, using screws or slide-on contact lugs, after which the lamp can be physically mounted in the lighting fixture. This requires the workman, often standing on a ladder, to use both hands. In some cases, the lamps can be plugged in, but in those cases the lighting fixture typically is limited to a single type of lamp. A conventional socket accommodating an AR111, for example, would not accommodate a PAR36 lamp.

In addition to providing significant practical advantages to the user, the lamp socket of the invention is of a highly simplified design, easily and inexpensively manufactured, and easily installed.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. A multi-purpose plug-in lamp socket for selectively mounting and connecting lamps of different types, characteristic of PAR36 or AR111 lamps, having a reflecting body, and a pair of relatively rigid, spaced-apart, strip-like contact elements mounted at a back portion of the reflecting body and having first portions extending generally laterally outward relative to a central axis of said reflecting body and second portions, positioned laterally outward of said first portions relative to said axis, extending at a substantial angle with respect to said first portions, wherein the lamp socket comprises (a) a socket body formed of insulating material, (b) laterally spaced apart contact clips mounted by said socket body, (c) said contact clips being formed of conductive metal having resilient characteristics, and being of generally u-shaped configuration defined by spaced apart contact side walls and a wall connecting said contact side walls, (d) said contact clips being mounted on said socket body and being positioned to receive and resiliently grip respective ones of said strip-like contact elements, with said strip-like contact elements disposed such that principal planar portions of strip-like material of which said contact elements are formed are disposed generally at right angles to the side walls of said contact clips, (e) each of said contact clips having, on opposed side walls thereof, opposed inwardly protuberant retention elements positioned to lie closely above and closely below planar portions of each of said strip-like contact elements after plug-in insertion of a lamp into said socket for resiliently retaining said lamp in a generally fixed position in said socket by engagement of said strip-like contact elements by said contact clips.

2. A multi-purpose plug-in lamp socket according to claim 1, wherein (a) said contact side walls have first and second inwardly protuberant retention elements, (b) said second retention elements being positioned below said first retention elements so as to lie closely below said planar portions of said strip-like contact elements after plug-in insertion of a lamp into said socket and serving to limit the downward extent of such plug-in insertion.

3. A multi-purpose plug-in lamp socket according to claim 2 wherein (a) said first and second retention elements are in a form of dimples pressed into the sidewalls of said contact clips, (b) said first retention elements being engaged and temporarily outwardly displaced by opposite side edges of planar portions of said strip-like contact elements during plug-in insertion of a lamp and projecting inward over upwardly facing surfaces of said planar portions after said plug-in insertion.

4. A multi-purpose plug-in lamp socket according to claim 1, wherein (a) said socket body is configured to mount a lamp in a predetermined rotational orientation relative to the socket body and is formed with a vertical opening in a bottom wall thereof, between said contact clips and generally aligned with a central vertical axis of said socket body, for reception of a mounting screw to accommodate rotational position adjustment of said socket body about said axis when said socket is used for mounting a lamp having an oriented output beam.

5. A multi-purpose plug-in lamp socket for selectively mounting and connecting lamps of different types, characteristic of PAR36 or AR111 lamps, having a reflecting body, and a pair of relatively rigid, spaced-apart, strip-like contact elements mounted at a back portion of the reflecting body and having first portions extending generally laterally relative to a central axis of said reflecting body and second portions extending at a substantial angle with respect to said first portions, wherein the lamp socket comprises (a) a socket body formed of insulating material, (b) laterally spaced apart contact clips mounted by said socket body, (c) said contact clips being formed of conductive metal having resilient characteristics, and being of generally u-shaped configuration defined by spaced apart contact side walls and a wall connecting said contact side walls, (d) said contact clips being mounted on said socket body and being positioned to receive and resiliently grip respective ones of said strip-like contact elements, with said strip-like contact elements disposed such that principal planar portions of strip-like material of which said contact elements are formed are disposed generally at right angles to the side walls of said contact clips, (e) said contact side walls having first and second inwardly protuberant retention elements positioned to lie closely above and closely below planar portions of said strip-like contact elements after plug-in insertion of a lamp into said socket for resiliently retaining said lamp in a generally fixed position in said socket, (f) said second retention elements being positioned below said first retention elements so as to lie closely below said planar portions of said strip-like contact elements after plug-in insertion of a lamp into said socket and serving to limit the extent of such plug-in insertion, (g) said first protuberant retention elements protruding inwardly a lesser distance than said second protuberant retention elements, whereby said planar portions can resiliently displace said first retention elements during a plug-in insertion of a lamp but meet with meet with increased resistance to resilient displacement of said second retention elements, whereby said planar portions are retained and positioned between said first and second retention elements.

6. A multi-purpose plug-in lamp socket for selectively mounting and connecting lamps of different types, characteristic of PAR36 or AR111 lamps, having a reflecting body, and a pair of relatively rigid, spaced-apart, strip-like contact elements mounted at a back portion of the reflecting body and having first portions extending generally laterally relative to a central axis of said reflecting body and second portions extending at a substantial angle with respect to said first portions, wherein the lamp socket comprises (a) a socket body formed of insulating material, (b) laterally spaced apart contact clips mounted by said socket body, (c) said contact clips being formed of conductive metal having resilient characteristics, and being of generally u-shaped configuration defined by spaced apart contact side walls and a wall connecting said contact side walls, (d) said contact clips being mounted on said socket body and being positioned to receive and resiliently grip respective ones of said strip-like contact elements, with said strip-like contact elements disposed such that principal planar portions of strip-like material of which said contact elements are formed are disposed generally at right angles to the side walls of said contact clips, (e) said contact side walls having first and second inwardly protuberant retention elements positioned to lie closely above and closely below planar portions of said strip-like contact elements after plug-in insertion of a lamp into said socket for resiliently retaining said lamp in a generally fixed position in said socket, (f) said second retention elements being positioned below said first retention elements so as to lie closely below said planar portions of said strip-like contact elements after plug-in insertion of a lamp into said socket and serving to limit the extent of such plug-in insertion, (g) said first and second retention elements being in a form of dimples pressed into the sidewalls of said of said contact clips, (h) said socket body having a vertical center axis, (i) said first retention elements being spaced a first predetermined distance from said center axis, and (j) said second retention elements being spaced a second predetermined distance from said center axis, and (k) said second predetermined distance being slightly greater than said first predetermined distance.

7. A multi-purpose plug-in lamp socket according to claim 6, wherein a first form of lamp, which said socket is adapted to receive, comprises spaced apart contact elements of generally inverted L-shaped configuration, each comprising generally horizontally disposed first planar portions and generally vertically downwardly disposed second planar portions integrally joined with outer end portions of said horizontally disposed first planar portions and forming therewith spaced apart, downwardly facing inside corner portions, the socket being characterized by (a) said second retention elements being positioned to engage said contact elements at said inside corner portions and to thereby support lamp of said first form against downward displacement and to position said lamp against lateral displacement relative to said socket body.

8. A multi-purpose plug-in lamp socket according to claim 7, wherein (a) said first retention elements are positioned to overlie upwardly facing surfaces of said first planar portions adjacent outer end portions thereof to resist outward movement of a lamp of said first form relative to said socket body.

9. A multi-purpose plug-in lamp socket according to claim 6, wherein a second form of lamp, which said socket is adapted to receive, comprises spaced apart contact elements each having first planar portions extending generally horizontally, second planar portions joined with outer ends of said first planar portions and extending outward and upward therefrom, and third planar portions joined with outer ends of said second planar portions and extending upwardly therefrom and forming therewith upwardly facing inside corner portions, the socket being characterized by (a) said first retention elements being positioned to engage said contact elements at said inside corner portions to resist outward movement of a lamp of said second form and to position a lamp of said second form against lateral displacement relative to said socket body.

10. A multi-purpose plug-in lamp socket according to claim 9, wherein (a) said second retention elements are positioned to engage downwardly facing surfaces of said second planar portions to resist inward movement of said lamp relative to said socket body.

11. The combination of a multi-purpose plug-in lamp and socket for selectively mounting and connecting lamps of different types which comprises, (a) a lamp having characteristics of PAR36 or AR111 lamps, including a reflecting body, and a pair of relatively rigid, spaced-apart, strip-like contact elements mounted at a back portion of the reflecting body and having first portions extending generally laterally outward relative to a central axis of said reflecting body and second portions, positioned laterally outward of said first portions relative to said axis, extending at a substantial angle with respect to said first portions, said lamp socket comprising, (b) a socket body formed of insulating material, (c) laterally spaced apart contact clips mounted by said socket body, (d) said contact clips being formed of conductive metal having resilient characteristics, and being of generally u-shaped configuration defined by spaced apart contact side walls and a wall connecting said contact side walls, (e) said contact clips being mounted on said socket body and being positioned to receive and resiliently grip respective ones of said strip-like contact elements, with said strip-like contact elements disposed such that principal planar portions of strip-like material of which said contact elements are formed are disposed generally at right angles to the side walls of said contact clips, (f) each of said contact clips having, on opposed side walls thereof, opposed inwardly protuberant retention elements positioned to lie closely above and closely below planar portions of each of said strip-like contact elements after plug-in insertion of said lamp into said socket for resiliently retaining said lamp in a generally fixed position in said socket by engagement of said strip-like contact elements by said contact clips.

* * * * *

UNITED STATES PATENT AND TRADEMARK OFFICE

CERTIFICATE OF CORRECTION

PATENT NO. : 6,875,036 B1
DATED : April 5, 2005
INVENTOR(S) : Kane et al.

It is certified that error appears in the above-identified patent and that said Letters Patent is hereby corrected as shown below:

Title page,
Item [75], Inventors, should read -- Kenneth M. Kane --.

Signed and Sealed this

Fourteenth Day of February, 2006

JON W. DUDAS
*Director of the United States Patent and Trademark Office*